United States Patent [19]

Birdsall et al.

[11] 4,411,098

[45] Oct. 25, 1983

[54] TOY VEHICLE

[75] Inventors: John D. Birdsall, 1262 Sunset Plz. Dr., Los Angeles, Calif. 90069; Ronald Liedtke, Addison; Marvin Smollar, Northbrook, both of Ill.

[73] Assignee: John D. Birdsall, Los Angeles, Calif.

[21] Appl. No.: 329,738

[22] Filed: Dec. 11, 1981

[51] Int. Cl.[3] ..... A63H 17/00

[52] U.S. Cl. ..... 46/206; 46/223

[58] Field of Search ..... 46/222, 223, 206, 201, 46/202, 81, 209, 74 B; 273/86 R

[56] References Cited

U.S. PATENT DOCUMENTS

| | | | |
|---|---|---|---|
| 2,517,884 | 8/1950 | Carver | 46/206 |
| 2,594,527 | 4/1952 | Wechsler | 46/208 |
| 3,462,878 | 8/1969 | Perryman et al. | 46/201 |
| 3,701,217 | 10/1972 | Jensen | 46/222 |
| 4,005,543 | 2/1977 | McKay | 46/81 |

FOREIGN PATENT DOCUMENTS

| | | | |
|---|---|---|---|
| 932358 | 8/1955 | Fed. Rep. of Germany | 46/222 |
| 837732 | 2/1939 | France | 46/206 |
| 1043010 | 9/1966 | United Kingdom | 46/206 |

*Primary Examiner*—Mickey Yu

*Attorney, Agent, or Firm*—Laff, Whitesel, Conte & Saret

[57] ABSTRACT

A toy wheeled vehicle has a chassis which can be adapted to receive almost any style of vehicle body. The vehicle contains an elongated coiled spring enclosed within a tube having a substantially rectangular cross section. The vehicle has a keyhole aligned with the tube in the trunk area. The key hole and the tube have a guideway slot formed therein. This slot, together with the rectangular cross section, insures a properly aligned key, at the time of key insertion. The key includes a pair of leaf spring-like, spaced parallel plate members joined on each end and held in a separated position by a spacer post or pin positioned near the operational or handle end of the key. When the key is inserted into the tube, the coiled spring is compressed. A latch on the key fits and locks into a keeper in the tube to hold the spring in the compressed condition. When the spaced parallel key plate members are squeezed together, the latch is forced out of the keeper, and the car shoots out and across a table top, floor, or other suitable flat surfaces, as the compressed spring is released.

12 Claims, 6 Drawing Figures

A
B

TOY VEHICLE

BACKGROUND OF THE INVENTION

This invention relates to toys, and more particularly, to wheeled vehicular toys which may be easily propelled by a child using a simulated key.

Children both learn and entertain themselves by playing with toys. The child also relates to those things which surround him during his day. Therefore, a toy is most successful when it simulates items which are regularly used around him. Hence, toy designers and manufacturers have a prime consideration for making toys that fit into events which the child encounters during his every day life.

A toy which meets these requirements and considerations is shown and described in U.S. patent application Ser. No. 146,228, filed May 5, 1980, John Birdsall, inventor. As there shown, a toy automobile contains an elongated coiled spring which is compressed when a simulated key is inserted into a "key hole" at the back of the car. A latch on the key locks it into place with the coiled spring compressed. If the key is then manipulated properly, the compressed spring is released suddenly to propel the car rapidly away from the key and across a table, floor, or other suitable flat surface.

For such toys to work well, it is important that the key does not bind in the keyhole so that it will not release quickly enough to propel the car. It is also important that the key does not release prematurely.

Accordingly, an object of the invention is to provide a key controlled car, in which the key does not bind within the key hole and does not prematurely release.

Yet another object of the invention is to provide toys having a flexible, easily manufactured, design so that any of a great many toy types may be manufactured on substantially the same production line and with substantially the same tools.

SUMMARY OF THE INVENTION

In keeping with an aspect of the invention, these and other objects are accomplished by a toy wheeled vehicle having a chassis, which can be adapted to receive almost any style of vehicle body. Thus, the toy appearance may be changed completely by a selection and use of any one of many bodies. The vehicle includes an elongated coiled spring enclosed within a tube having a substantially rectangular cross section. Both a keyhole in the trunk area, and the tube have a guideway slot formed therein which, together with the rectangular cross section, insures a properly aligned key, at the time of key insertion. The key includes a pair of spaced parallel plate members, having a leaf spring quality, joined on each end and held in a separated condition by a post or pin positioned near the operational or handle end of the key. When the key is inserted into the tube, the coiled spring is compressed. A latch on the key fits and locks into a keeper in the tube to hold the spring in the compressed condition. When the spaced parallel, key plate members are squeezed together, the latch is forced out of the keeper. Since, compared to the car, the hand holding the key is relatively immobile, the car shoots out and across a table top, floor, or other suitable flat surfaces, as the compressed spring is released.

BRIEF DESCRIPTION OF THE DRAWINGS

A preferred embodiment of the invention is seen in the attached drawing, wherein.

DESCRIPTION OF A PREFERRED EMBODIMENT

Figures 1, 2, 3, 4, 5, 6:
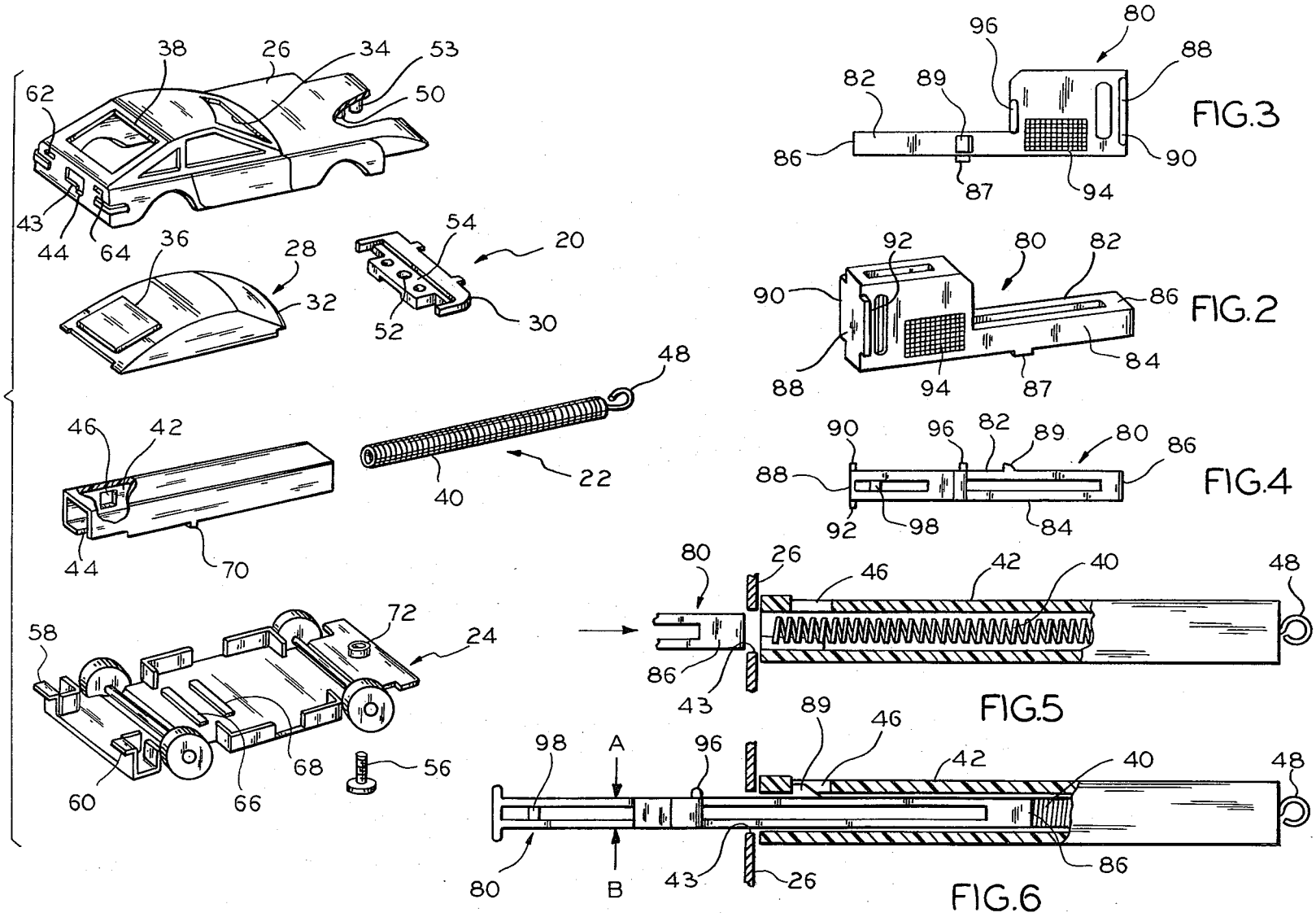
FIG. 1 is an exploded view, in perspective, of the inventive wheeled vehicle with the hood partially broken away to show a spring anchor post and a spring tube partially broken away to show a keeper.
FIG. 2 is a perspective view of the inventive key.
FIG. 3 is a side elevation of the key.
FIG. 4 is a top plan view of the key.
FIG. 5 is a stop motion view, in cross section, of the coiled spring at the time when the key is about to be first inserted into a key hole in the back of the car.
FIG. 6 is a stop motion view, in similar cross section, showing the key, latched in the keeper with the coiled spring compressed.

The major assemblies of the inventive toy (FIG. 1) are a body assembly 20, a coiled spring and its enclosing tube assembly 22, and a chassis 24. The body assembly 20 (which may be made of molded plastic) includes a body shell 26 of any convenient design and appearance, a window shell 28 and a front bumper 30. The body shell 26 has a "key hole" 43 formed in the back or trunk area. The window shell 28 has a ledge 32 which hooks over the windshield opening 34 in the body and another edge 36 which fits into the top 38 of the rear window opening. This window shell 28 may have any convenient appearance, such as transparent glass, or a solid color which contrasts with the body color. The vehicle is especially attractive when the shell 28 is black.

The spring assembly 22 includes a coiled spring 40 and a tubular member 42 for enclosing and containing the spring, snuggly enough to keep the coils of the spring in axial alignment during its compression and release cycle. The tubular member fits inside the car body with its open end confronting "key hole" 43, so that a key may be inserted through hole 43 and into the tube 42. Both the hole 43 and the tube 42 have a rectangular cross section (preferably square). In the key hole 43 and near the front of the tube 42, there are guide way slots 44 for receiving a tab 87 on the key to prevent the key from being properly inserted in any except an upright position.

One side of the tube has a hole or keeper 46 which enables the key to latch into position, with the spring in a compressed condition. The child is required to hold the key securely at the time when the vehicle is to be propelled. Therefore, when the latch is dislodged from this keeper, the compressed spring is released suddenly, and the car is propelled away from the key.

The coiled spring 40 lies a little loosely inside the tube 42. An end loop or two of the coiled spring is rotated away from the axis of the coil to form an anchor eye 48 which fits over a post 50 on the underside of the hood. After the anchor eye is in place on post 50, bumper assembly 30 is positioned with hole 52 over a second post 53, with a recess 54 receiving the post end.

The chassis 24 of the toy wheeled vehicle is preferably made of a die cast metal. The die casting includes two rearly projecting tabs 58, 60 which fit into cut outs or openings 62, 64 formed in the tail light area of the vehicle body shell 26. The floor of the chassis includes two upstanding bosses 66, 68 which position a tab 70 on the bottom of tube 42. The body shell 26 also includes suitable internal bosses for further stabilizing the positions of the tube 42 and spring eye 48.

After the toy assemblies are completely put together, a screw 56 is passed through a hole 72 on the chassis, hole 52 on the bumper assembly, and a hole (not seen) in post 53 on the underside of the hood.

The key 80 is seen in FIGS. 2–4, as including a pair of spaced parallel, side plates 82, 84 which are joined together on their opposite ends 86, 88. The cross section of tip end 86 is rectangular, and substantially fills the cross section of the tube. The face of the tip end which presses upon the coiled spring 40 is substantially perpendicular to the axis of the spring 40. The key is integrally molded from a plastic material, having a memory which gives the side plates 82, 84 a leaf spring-like quality. Key 80 has an overall configuration profile which is substantially that of an automobile key, to heighten the child's illusion of having a car and key.

One side plate 84 of the key includes a dependent tab 87 that fits through guide way 44 in key hole 43 and into the tube 42, to discourage insertion of the key in an upside-down manner.

The other side plate 82 includes a latch 89, which is a wedge that guides itself and snaps into keeper hole 46 (FIG. 1), under the urging of the spring-like qualities of the plastic memory. The handle end of the key includes opposed flanges 90, 92 and scored sections 94. A front flange 96 helps position the thumb during key insertion and the subsequent release of the latch.

A spacer pin 98 is positioned between side plates 82, 84 and near the back or handle of the key to stabilize the spacing between spring plates. This way, a thumb and forefinger (arrows A, B, FIG. 6) pressing on the scored parts 94 of the two key plates cause the plates to move together in the area of latch 89.

The toy vehicle is operated by inserting the forward end 86 (FIG. 5) of key 80 through key hole 43 in the body shell and into the tube 42. Insertion continues until latch 89 snaps into keeper 46 (FIG. 6), at which time, spring 40 is compressed between key end 86 and post 50. The child now aims the vehicle in the desired direction, while holding it and the key over a table, floor, or other suitable flat surface. Pressure is applied (at A, B—FIG. 6) on the opposite sides of the key. The latch 89 is forced out of keeper 46 and the car is propelled by the sudden release of compressed spring 40.

An advantage of toys having the present design is a key action which does not bind on release. This non-binding action results from certain aspects of the design. The eyelet and post 50 give a positive front anchoring point so that the coils of spring 40 remain aligned during compression. The rectangular cross section of the tube, guide way slot, and keeper positions insure alignment of the key, again to maintain good coiled spring alignment during compression. The rectangular cross-sectional configuration also enables the positions of the tube to be well stabilized by internal ribs, posts, bosses, etc. which are integrally molded into the body shell and chassis. The tip end of the key is flat and perpendicular to the axis of the spring so that it spreads the forces uniformly over the entire face of the spring during compression. The spacer pin provides a positive leaf spring action when the latch is forced out of the keeper. The flanges on the key give a positive grip which facilitates better manipulation, in the intended manner. All of these things contribute to a reduction of binding because all forces are aligned with the axis of the coiled spring and tube.

Those who are skilled in the art will readily perceive how modifications may be made in the invention. Therefore, the appended claims should be construed to cover all equivalent structures.

We claim:

1. A toy wheeled vehicle comprising a body having a key hole in the back area aligned with a tube inside the vehicle in a confronting relationship; an elongated coiled spring inside said tube; key means for linear insertion through said keyhole and into said tube; said key, keyhole, and tube being shaped to stabilize the positions of the key and coiled spring and to restrict key movement to a fixed orientation with only a substantially linear insertion and release motion; said key means comprising an elongated pair of spaced parallel plates joined on opposite ends having a handle on one end and a blade leading to a tip on the other end; latch means formed in the blade area on a side of at least one plate of said key to lock into mating keeper means formed on a confronting side of said tube; and spacer pin means positioned between said plates at a position intermediate said opposite ends which requires said side plates to flex in the area of said latch means when said plates are squeezed together.

2. The toy of claim 1 wherein the tip end of said key has a cross section which substantially fills the cross sectional area of said tube and presents a flat face which is substantially perpendicular to an axis of said spring.

3. The toy of claim 1 or claim 2 wherein the stabilizing shape of said key and tube is a substantially rectangular cross section, with mating guide ways formed in said keyhole, and tube to receive an aligning tab on said key which prevents insertion of said key in an incorrect orientation.

4. The toy of claim 3 wherein the handle end of said key has flanges which limit the distance of insertion of said blade and facilitate a manipulation of said key.

5. The toy of claim 4 wherein score lines are formed on said key to identify the place where said key is squeezed.

6. The toy of claim 4 wherein an end of said coiled spring has at least one loop rotated to lie substantially perpendicular to an axis of said coil, and post means formed on the interior of said body for receiving and anchoring said spring loop and for providing a positive support against which the spring is compressed.

7. A toy vehicle comprising a body having a substantially rectangular keyhole with a key aligning dependent slot in the back of the vehicle body and with a tube having substantially the same rectangular cross section with a key aligning dependent slot confronting said keyhole, said keyhole and cross section cooperating to provide linear key insertion and removal with a fixed orientation of said key, a coiled spring lying inside said tube with an end firmly anchored to said body at a point which is axially aligned with said tube and remote from said keyhole, elongated key means having a cross sectional shape with a dependent alignment tab which accurately conforms to the shape of said keyhole in the back of said body and cross section of said tube, said key having a substantially flat face perpendicular to an axis of said tube, latch means formed at confronting and cooperating locations on said key and in said tube, said key having two spaced parallel side plates with said tab being formed on one of said plates for stabilizing said one plate, a spacer pin at a location which forces the other of said plates to flex in the location of said latch while said tab and dependent slots stabilizes said one plate to open said latch when said side plates are squeezed together.

8. The toy of claim 7 wherein said key is made of a plastic material, having a memory which give said side plates a leaf spring-like quality.

9. A toy vehicle comprising a body having a keyhole in the back area; a tube inside the body aligned with the keyhole in a confronting relationship; an elongated coiled spring inside said tube; a key having a handle and a blade for linear insertion through said keyhole and into said tube, said key comprising an elongated pair of spaced parallel plates which are joined on opposite ends with said handle on one end and said blade leading to a tip on the other end; a keeper formed on said tube; a latch formed in the blade area and on a side of at least one plate of said key to lock into mating engagement with said keeper; and means positioned between joined ends of said plates for spacing said plates so that when said plates are squeezed together the plates flex in the area of said latch and not at said spacing means to unlock the latch from the keeper.

10. A toy vehicle comprising a body having a keyhole in the back area; a tube inside the body aligned with the keyhole in a confronting relationship; an elongated coiled spring inside said tube; a key simulating an automotive key having a handle and a blade for linear insertion with a fixed orientation through said keyhole and into said tube, said key comprising an elongated pair of spaced parallel plates having said handle on one end and said blade leading to a tip on the other end; a keeper associated with the body; a latch formed on said blade and on a side of at least one plate of said key to lock into mating engagement with said keeper; and means positioned between said plates and intermediate the handle and tip for holding said plates in a separated position so that when said plates are squeezed together the plates flex in the area of said latch to unlock the latch from the keeper.

11. A toy vehicle comprising a body and a chassis, said body having a front end and a back end, a pair of cutout areas formed in an elevated region in said back end of said body near positions normally occupied by vehicle tail lights, first means near the front end of said body for receiving a fastener means, said chassis also having a front end and a back end with a pair of elevated horizontal tabs at said back end, said tabs fitting through said cutout areas when said body is properly positioned on said chassis, second means at the front end of said chassis positioned to cooperate with said first means, fastener means for cooperating with said first and second means for securing said body to said chassis, a key hole formed in said back end of said body and centrally located between said cutout areas with a tube positioned inside said body and aligned with said key hole, a key having a handle and a blade for linear insertion with a fixed orientation through said keyhole and into said tube, and a coiled spring positioned inside said tube and having an end secured to said fastener means, an insertion of said key through said hole compressing said spring to propel said vehicle upon a release of said key from said insertion position.

12. The toy of claim 11 wherein said fastener means is a screw.

* * * * *